US006790078B1

(12) United States Patent
Nieslony

(10) Patent No.: US 6,790,078 B1
(45) Date of Patent: Sep. 14, 2004

(54) CONTACT PROTECTION HOUSING, INJECTION PUMP AND METHOD FOR MOUNTING A CONTACT PROTECTION HOUSING WITH THE AID OF AN ADAPTER

(75) Inventor: Markus Nieslony, Haslach (DE)

(73) Assignee: Robert Bosch GmbH, Stuttgart (DE)

( * ) Notice: Subject to any disclaimer, the term of this patent is extended or adjusted under 35 U.S.C. 154(b) by 272 days.

(21) Appl. No.: 09/914,566

(22) PCT Filed: Nov. 21, 2000

(86) PCT No.: PCT/DE00/04099

§ 371 (c)(1),
(2), (4) Date: Dec. 18, 2001

(87) PCT Pub. No.: WO01/50552

PCT Pub. Date: Jul. 12, 2001

(30) Foreign Application Priority Data

Dec. 31, 1999 (DE) ..... 199 63 933

(51) Int. Cl.[7] ..... H01R 13/52
(52) U.S. Cl. ..... 439/521

(58) Field of Search ..... 439/521, 936, 439/519, 522, 135, 130; 174/138 F, 187, 188, 77 R, 84 R, 135

(56) References Cited

U.S. PATENT DOCUMENTS 4,382,242 A 5/1983 Colvin et al.
5,246,383 A * 9/1993 Shimirak et al. ..... 439/521

FOREIGN PATENT DOCUMENTS

DE 23 53 444 A 6/1975
GB 2 061 621 A 5/1981

* cited by examiner

*Primary Examiner*—Ross Gushi
(74) *Attorney, Agent, or Firm*—Ronald E. Greigg

(57) ABSTRACT

A contact protection housing for at least one electrical terminal that is disposed in a housing part mounted on a component and in which an opening for introducing potting composition is made. The invention also relates to an injection pump, having a contact protection housing as described above, and to a method for mounting a contact protection housing, with an adapter. The housing part is formed by a thin-walled cap, whose edge rests constantly on the component by initial tension.

7 Claims, 2 Drawing Sheets

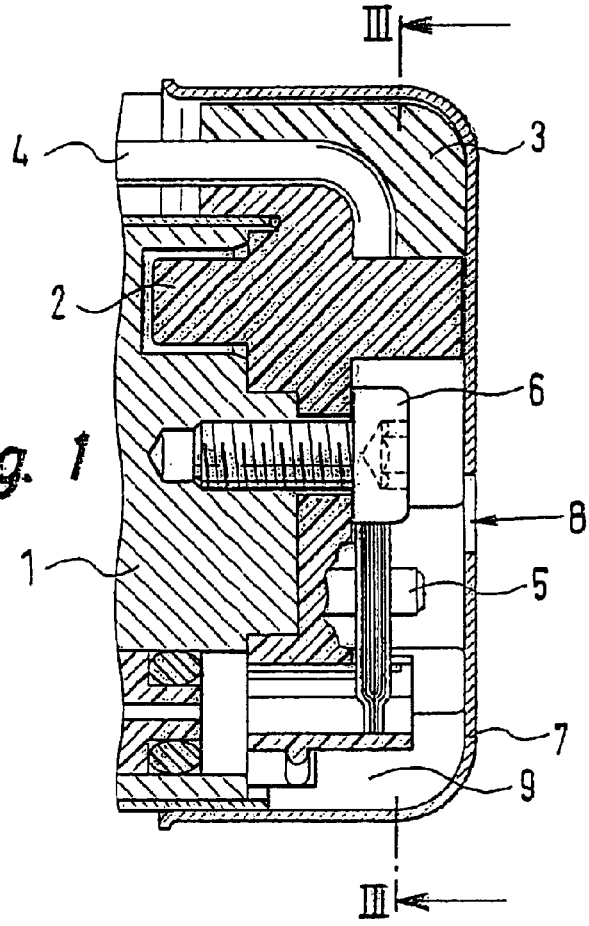
Fig. 1
Fig. 2
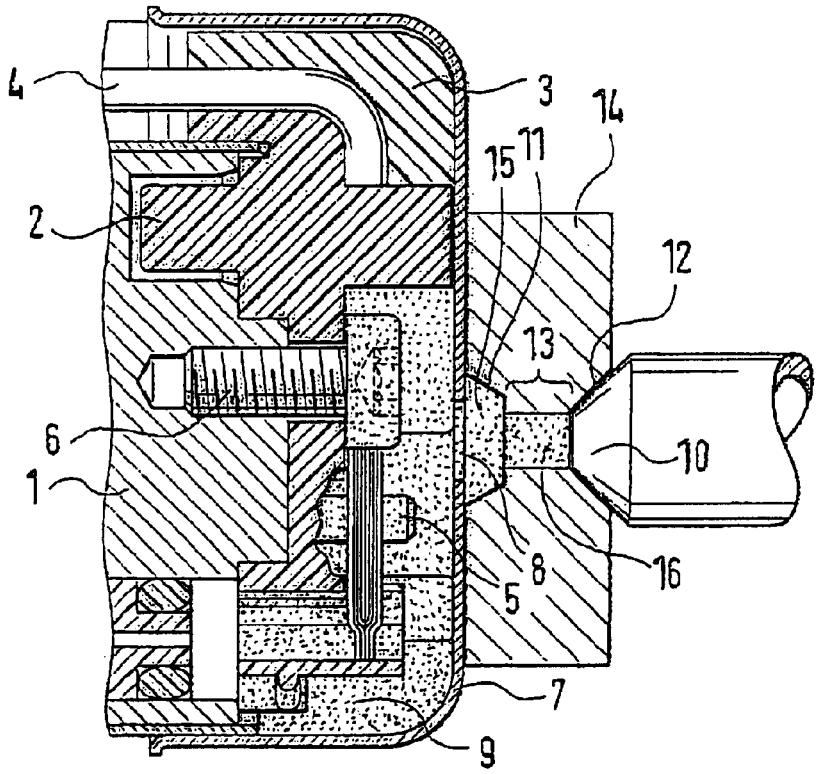

CONTACT PROTECTION HOUSING, INJECTION PUMP AND METHOD FOR MOUNTING A CONTACT PROTECTION HOUSING WITH THE AID OF AN ADAPTER

CROSS-REFERENCE TO RELATED APPLICATIONS

This application is a 35 USC 371 application of PCT/DE 00/04099 filed on Nov. 21, 2000.

BACKGROUND OF THE INVENTION

1. Field of the Invention

The invention relates to a contact protection housing for at least one electrical terminal that is disposed in a housing part which is mounted on a component and in which an opening for introducing potting composition is made. The invention also relates to an injection pump, having a contact protection housing as described above. The invention also relates to a method for mounting a contact protection housing, with an adapter.

2. Description of the Prior Art

German Patent Disclosure DE 197 03 686 discloses a contact protection housing which comprises two assembled housing parts. There is a seal between the two housing parts. The seal holds back potting composition that has not yet set during filling. The seal must be positioned precisely when the contact protection housing is put together. Furthermore, the seal is vulnerable to wear.

OBJECTS AND SUMMARY OF THE INVENTION

It is an object of the invention to furnish a contact protection housing which is formed of fewer individual parts than conventional contact protection housings. The effort and expense of assembly should also be reduced.

In a contact protection housing for at least one electrical terminal that is disposed in a housing part which is mounted on a component and in which an opening for introducing potting composition is made, this object is attained in that the housing part is formed by a thin-walled cap, whose edge rests constantly on the component by initial tension. This offers the advantage that the seal required in conventional contact protection housings can be omitted.

A particular embodiment of the contact protection housing of the invention is characterized in that the cap takes the form of a cylinder, open on one face end, on whose jacket face a protrusion tapering to a sharp point is provided, the flanks of which protrusion are embodied as slightly concave. The concave embodiment brings about an elastic adaptation of the flanks of the cap to the component. As a result, production-dictated tolerances of the component can be compensated for. Venting the cavity during the potting takes place automatically via the remaining slight gaps between the line holder and a magnet valve with which it is used.

In an injection pump, in particular a distributor injection pump, for motor vehicles, on which pump a magnet valve is secured with the aid of a hollow clamping screw, the above-stated objected is attained by a contact protection housing whose protrusion protrudes past the circumference or inside diameter of the hollow clamping screw. As a result, in the mounted state, an undesired dismantling of the magnet valve is reliably prevented.

In the use of the cap of the invention, quality problems in the region of the gate have occurred at high fill nozzle temperatures. It is therefore a further object of the invention to disclose a fast mounting method in which even at high fill nozzle temperatures, damage to the potting composition is averted.

In a method for mounting a contact protection housing as described above on a component, in particular on an injection pump as described above, in which the potting composition is introduced with the aid of a nozzle, this object is attained in that while the potting composition is being introduced, there is an adapter disposed between the cap and the nozzle. The adapter part separates the nozzle from the cavity. The spacing, forced by the adapter part, between the cap and the nozzle prevents thermal destruction of the potting composition in the region of the fill opening in the cap.

An adapter for the use of the method described above is characterized in that the adapter has a through bore with a first portion, whose diameter is larger than the diameter of the opening in the cap for introducing the potting composition, and having a conical second portion, which tapers from the inside outward. The first portion serves to compensate for imprecisions in attaching the nozzle to the cap. As a result, perfect filling of the cap is also assured even if the nozzle opening is not disposed precisely concentrically with the cap opening. The forming composition remaining outside the cap in the region of the cap opening after the filling operation forms a button, which is integral with the forming composition in the interior of the cap. The button has a larger diameter than the opening in the cap and as a result prevents detachment and undesired removal of the cap after mounting. The conical second portion of the adapter serves to seal off the fill nozzle and center it.

A particular type of embodiment of the adapter of the invention is characterized in that the first portion tapers from the inside outward. This assures good unmolding once the potting composition has been introduced into the cap.

A further embodiment of the adapter of the invention is characterized in that a cylindrical third portion is disposed between the first portion and the second portion. The connection can also be conical, with tapering in the direction of the nozzle, and/or can be profiled. The third portion allows the potting composition to pass through in the introduction process. Via the length of the third portion, the spacing between the nozzle and the cap can be varied. The magnitude of the spacing between the nozzle and the cap depends, among other factors, on the temperature of the nozzle in the introduction process.

BRIEF DESCRIPTION OF THE DRAWINGS

Further advantages, characteristics and details of the invention will become apparent from the ensuing description, in conjunction with the drawings, in which:

FIG. 1 is a sectional view through a contact protection housing of the invention, in the empty state;

FIG. 2 shows the contact protection housing of FIG. 1 in the filled state;

DESCRIPTION OF THE PREFERRED EMBODIMENT

Figure 3:
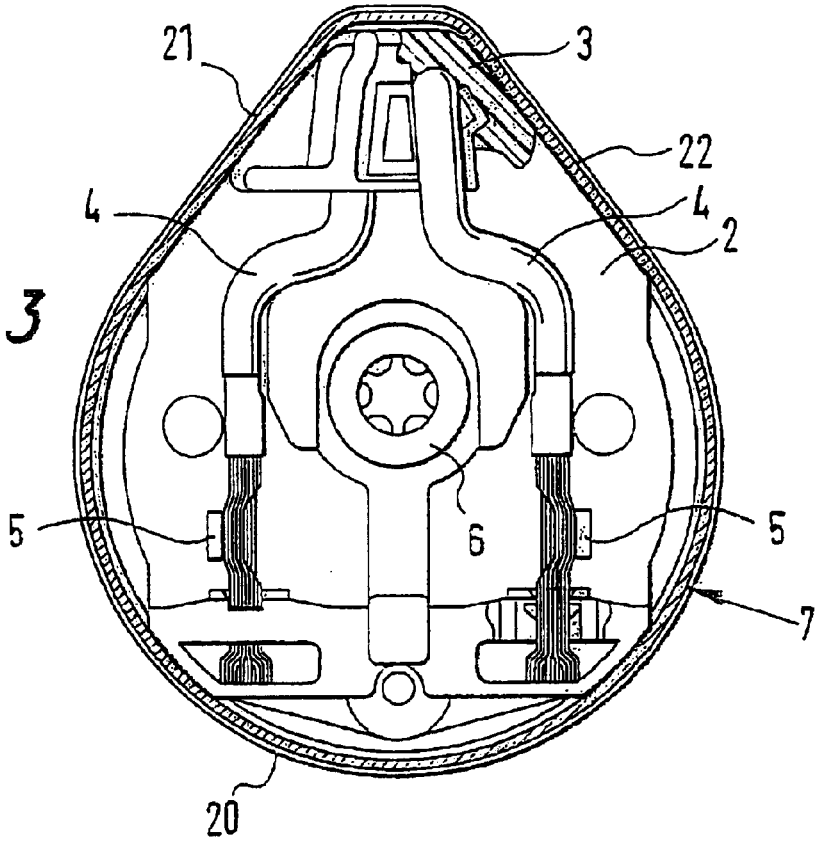
FIG. 3 is a section along the line III—III of FIG. 1.

In FIG. 1, a magnet valve 1 is shown, which with the aid of a hollow clamping screw (not shown) is mounted on a distributor injection pump (also not shown). A line holder 2 is mounted on the magnet valve 1. The line holder 2 includes a fixation aid 3, which has a substantially triangular outer contour. The line holder 2 and the fixation aid 3 serve to receive electrical lines 4. The electrical lines 4 are disposed in the line holder 2 in such a way that they are positioned with the least possible spacing on the contact lugs 5 that originate at the magnet valve 1. The line holder 2 is secured to the magnet valve 1 with the aid of a screw 6.

The connection points of the magnet valve 1 are surrounded by a cap 7, in which an opening 8 is made. The opening 8 in the cap 7 serves to enable filling of the hollow interior 9 of the cap 7, which is also known as a cavity, with a potting composition.

In FIG. 2, the cavity 9 is filled with potting composition. The introduction of the potting composition is done through a nozzle 10. Between the nozzle 10 and the cap 7 of the contact protection housing of the invention, there is an adapter 14. By means of the adapter 14, the cap 7 is thermally decoupled from the nozzle 10.

The adapter 14 has a central through bore with first portion 11, a second portion 12, and a third portion 13. The third portion 13 has the form of a circular cylinder and is disposed between the first portion 11 and the second portion 12. The connection can also be conical, with tapering in the direction of the nozzle, and/or profiled. The third portion 13, upon injection of the potting composition, forms a gate or spur 16, which is removed after assembly.

The second portion 12 is embodied conically and serves to receive the tip of the nozzle 10. The first portion 11 of the through bore in the adapter 14 is likewise embodied conically. The two cones in the portions 11 and 12 of the adapter 14 both taper toward the middle portion 13, which has the smallest diameter of the three portions.

In the interior of the first portion 11, the potting composition forms a button 15. The button 15 has an outside diameter that is greater than diameter of the bore 8 in the cap 7.

In FIG. 3, it can be seen that the cap 7 has a cylindrical outer contour 20, on which a generally triangular protrusion is formed whose flanks are identified by reference numerals 21 and 22. The tip of the protrusion is embodied in flattened fashion.

Figure 4:
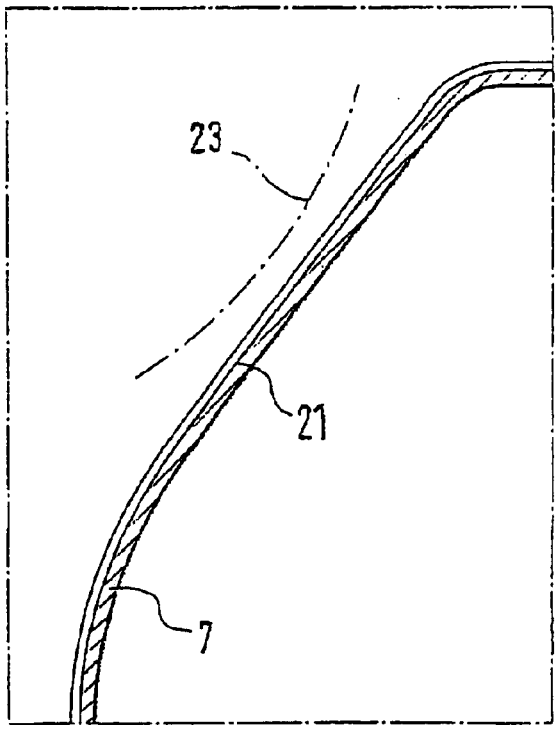
FIG. 4 is an enlarged detail of the contact protection housing shown in FIG. 3.

In FIG. 4, the region of the flank 21 of the cap 7 of FIG. 3 is shown enlarged. The flank 21 of the cap 7, in the built-in state, rests on the housing of the magnet valve 1. It is indicated at 23 that the flank 21 of the cap 7, in the non-built-in state, is embodied as slightly concave, that is, as bulging inward.

For the sake of high-pressure sealing, the magnet valve 1 must be secured to the distributor injection pump with the aid of the concentrically disposed hollow clamping screw, with a high tightening torque. A trailing cable on the magnet valve 1 would be extremely vulnerable to being damaged. The magnet valve 1 therefore has only two protruding contact lugs 5 for the sake of later contacting. Because of the stringent demands made of it in operation, the contacting means should be embodied inseparably. It must be protected against mechanical stress and against media. All the work operations for contacting purposes must be capable of being executed within a predetermined, short assembly cycle. All of these specifications are met by the invention. The assembly of the contact protection housing of the invention proceeds as follows.

First, the magnet valve 1 is screwed to the distributor injection pump (not shown). Then the line holder 2, with the electrical lines 4, is slipped onto the exposed face end of the magnet valve 1. In the process, the two contact lugs 5 of the magnet valve 1 are passed through appropriate openings into the line holder 2. The cable ends of the electrical lines 4 are disposed and fixed in such a way that they are always at a slight spacing from the contact lugs 5.

Next, with the aid of the screw 6, the line holder 2 is screwed to the magnet valve 1. After that, the contacting between the cable ends of the electrical lines 4 and the contact lugs 5 is effected by resistance welding. Soldering or other welding processes are also possible.

In the next step, the covering cap 7 is pressed onto the magnet valve 1 and the line holder 2, until its bottom comes into contact with the line holder 2. The covering cap 7 is embodied such that the edge of the cap rests constantly with initial tension on the magnet valve 1 and on the hump-shaped fixation aid 3. As a result, when the potting composition is then introduced, sealing without an additional sealing element is achieved.

The cavity 9 in the interior of the cap 7 is filled up with potting composition. Hot melt adhesive, which is introduced with overpressure, is used as the potting composition. Hot melt adhesive offers the advantage of not requiring any additional importation of heat or a long reaction time at room temperature. However, within the scope of the present invention, other potting compositions can be used instead.

While the potting composition is being introduced, the cap 7 is held down with the adapter 14. A visible bulge 15, also known as a button, is preserved in the gate region. The button creates a positive engagement, for the sake of axially fixing the cap 7, that reinforces the frictional engagement after the cap is pressed on. By the adhesion of the potting composition to the cap 7, the cap is additionally retained and vibration-damped. Further tasks of the potting composition are securing the fastening screw 6 of the line holder 2, insulating the contacts from one another and from ground, protecting the contacts against media, and filling up small voids and undercuts in order to prevent suction.

By means of the version according to the invention, not only the advantages of mounting the magnet valve 1 to the pump without a trailing cable, and the well-known high functional safety of trailing cable contacting in operation can be exploited. The construction according to the invention can be used in small component assemblies and in already-complete products. The requisite mounting steps can be integrated within a short-cycle line assembly process.

The clamping screw (not shown) of the magnet valve 1 is caught under the covering cap 7, since the covering cap 7 has radially larger dimensions than the magnet valve 1. It is impossible to remove the covering cap 7 without causing mechanical damage.

The clamping screw (not shown) of the magnet valve 1 is caught under the covering cap 7, since the covering cap 7 has radially larger dimensions than the magnet valve 1. It is impossible to remove the covering cap 7 without causing mechanical damage.

The foregoing relates to preferred exemplary embodiment of the invention, it being understood that other variants and embodiments thereof are possible within the spirit and scope of the invention, the latter being defined by the appended claims.

I claim:

1. A fuel distributor injection pump for motor vehicles, on which pump a magnet valve (1) is secured with the aid of a hollow clamping screw, said pump comprising a contact protection housing at least one electrical terminal that is disposed in a housing part (7) mounted on said magnet valve (1) and in which an opening (8) for introducing potting composition is made, said housing part being formed by a thin-walled cap (7), whose edge rests constantly on said magnet valve (1) by initial tension, said cap (7) being in the form of a cylinder (20), open on one face end, on whose jacket face a protrusion tapering to a sharp point is provided, the flanks (21, 22) of which protruding are embodied as slightly concave, said contact protection housing protrusion protruding past the inside diameter of said hollow clamping screw.

2. A contact protection housing for at least one electrical terminal that is disposed in a housing part (7) which is mounted on a component (1) and in which an opening (8) for introducing potting composition is made, said housing part comprising a thin-walled cap (7), whose edge rests constantly on the component (1) by initial tension, wherein said cap (7) is in the form of a cylinder (20), open on one face end, on whose jacket face a protrusion tapering to a sharp point is provided, the flanks (21, 22) of which protrusion are embodied as slightly concave.

3. A method for mounting a contact protection housing for at least one electrical terminal that is disposed in a housing part (7) which is mounted on a component (1) and in which an opening (8) for introducing potting composition is made, said housing part having a thin-walled cap (7), whose edge rests constantly on the component (1) by initial tension said method comprising introducing said potting composition is introduced with the aid of a nozzle (10) an adapter (14) disposed between the cap (7) and the nozzle (10).

4. An adapter for the use of the method of claim 3, wherein said adapter (14) has a through bore with a first portion (11), whose diameter is larger than the diameter of the opening (8) in the cap (7) for introducing the potting composition, and having a conical second portion (12), which tapers from the inside outward.

5. The adapter of claim 4, wherein said adapter further comprising a cylindrical third portion (13) disposed between the first portion (11) and the second portion (12).

6. The adapter of claim 4, wherein first portion (11) of said adapter tapers from the inside outward.

7. The adapter of claim 6, wherein said adapter further comprising a cylindrical third portion (13) disposed between the first portion (11) and the second portion (12).

* * * * *